United States Patent [19]

Bobart et al.

[11] Patent Number: 4,541,746

[45] Date of Patent: Sep. 17, 1985

[54] INITIALIZING APPARATUS FOR DAISY WHEEL PRINTER

[75] Inventors: Kevin L. Bobart; Robert S. Samson; Iraj D. Shakib, all of Lexington, Ky.

[73] Assignee: International Business Machines Corporation, Armonk, N.Y.

[21] Appl. No.: 542,300

[22] Filed: Oct. 14, 1983

[51] Int. Cl.[4] ..... B41J 7/76; B41J 7/84

[52] U.S. Cl. ..... 400/144.2; 400/154.4

[58] Field of Search ..... 400/144.1, 144.2, 144.3, 400/61, 64, 67, 76, 68, 283, 319, 320, 139, 154.4

[56] References Cited

U.S. PATENT DOCUMENTS

| | | | |
|---|---|---|---|
| 3,574,326 | 4/1971 | Koehn . | |
| 3,858,509 | 1/1975 | Grundherr | 400/144.2 X |
| 4,074,798 | 2/1978 | Berger | 400/144.3 |

FOREIGN PATENT DOCUMENTS

| | | | |
|---|---|---|---|
| 2545311 | 4/1976 | Fed. Rep. of Germany | 400/144.2 |
| 7507753 | 1/1976 | Netherlands | 400/144.2 |
| 1604577 | 12/1981 | United Kingdom . | |
| 2093244 | 8/1982 | United Kingdom | 400/144.2 |

OTHER PUBLICATIONS

Xerox Disc. Journal, "An Arrangement for Encoding Impact Energy . . . ", Sohl, vol. 1, Nos. 9/10, Sep./Oct. 1976, p. 25.

Xerox Disc. Journal, "Print Wheel Sensing Scheme", Cocksedge et al., vol. 4, No. 3, May/Jun. 1979, p. 415.

IBM Tech. Disc. Bulletin, "Single Sensor for Carrier Homing . . . ", Quinn, vol. 25, No. 11A, Apr. 1983, pp. 5818–5819.

IBM *Technical Disclosure Bulletin,* vol. 24, No. 1A, Jun. 1981, entitled "Pitch Sensing Device" by S. A. Okcuoglu et al., pp. 146–147.

*Primary Examiner*—Edgar S. Burr

*Assistant Examiner*—James R. McDaniel

*Attorney, Agent, or Firm*—Laurence R. Letson

[57] ABSTRACT

An LED/photodetector structure is disclosed positioned to cooperate with a daisy wheel print element of a daisy wheel printer and a light interrupter such that under microprocessor control, a stepping motor will rotate and home the daisy wheel print element, sense the escapement pitch corresponding to that element, sense the font weight or impact force level associated with that print element and then cause the carrier to be translated to the left frame, thereby engaging the light beam interrupter with the left frame and forcing it into the light beam indicating the presence or the carrier at a known spacial position for homing of the carrier position.

The data carried by the print element in the form of apertures formed in the hub thereof and are all spacially positioned within one semicircular portion of the print element hub.

10 Claims, 7 Drawing Figures

FIG. 1
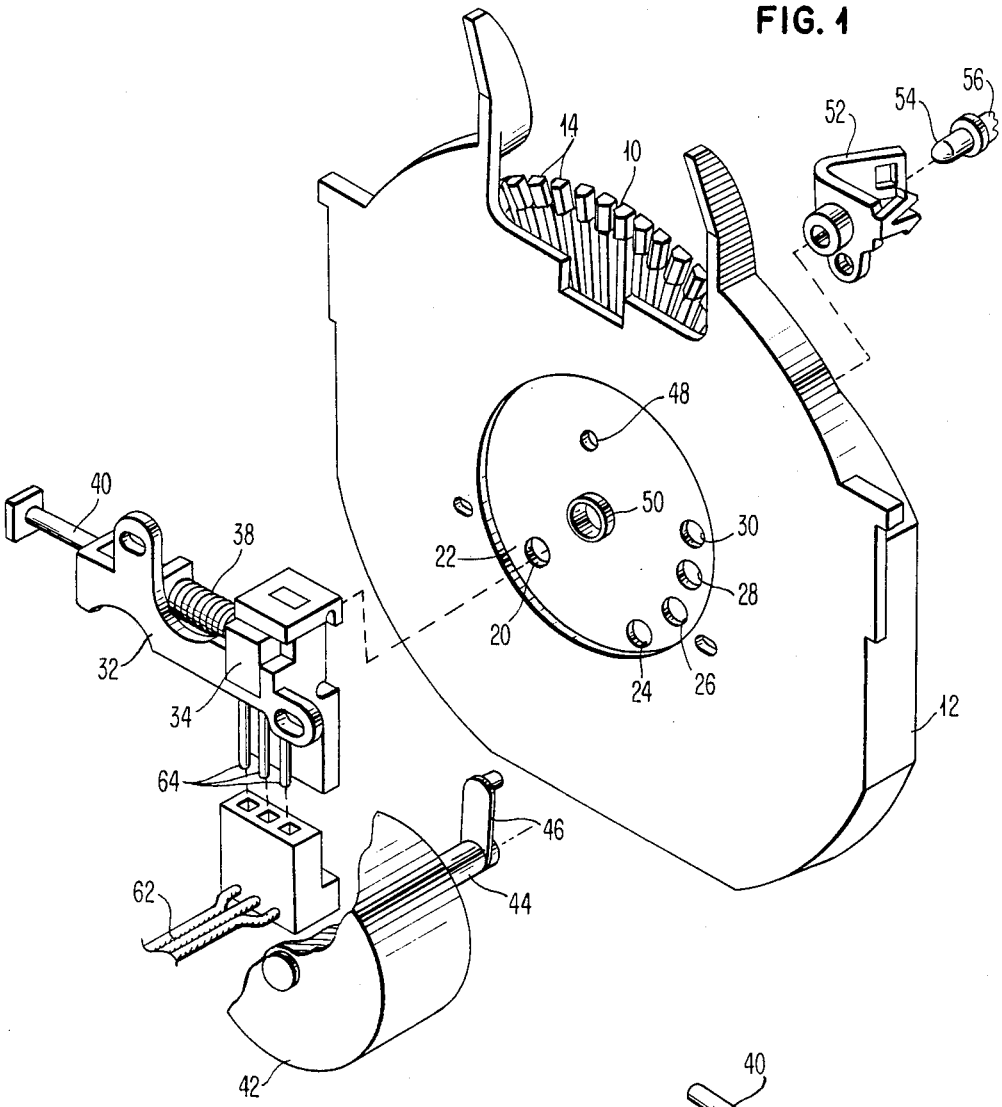
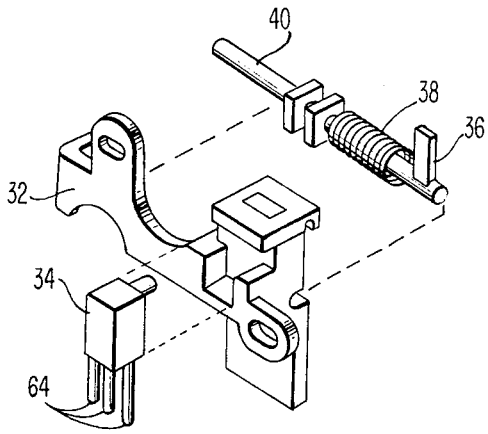
FIG. 2

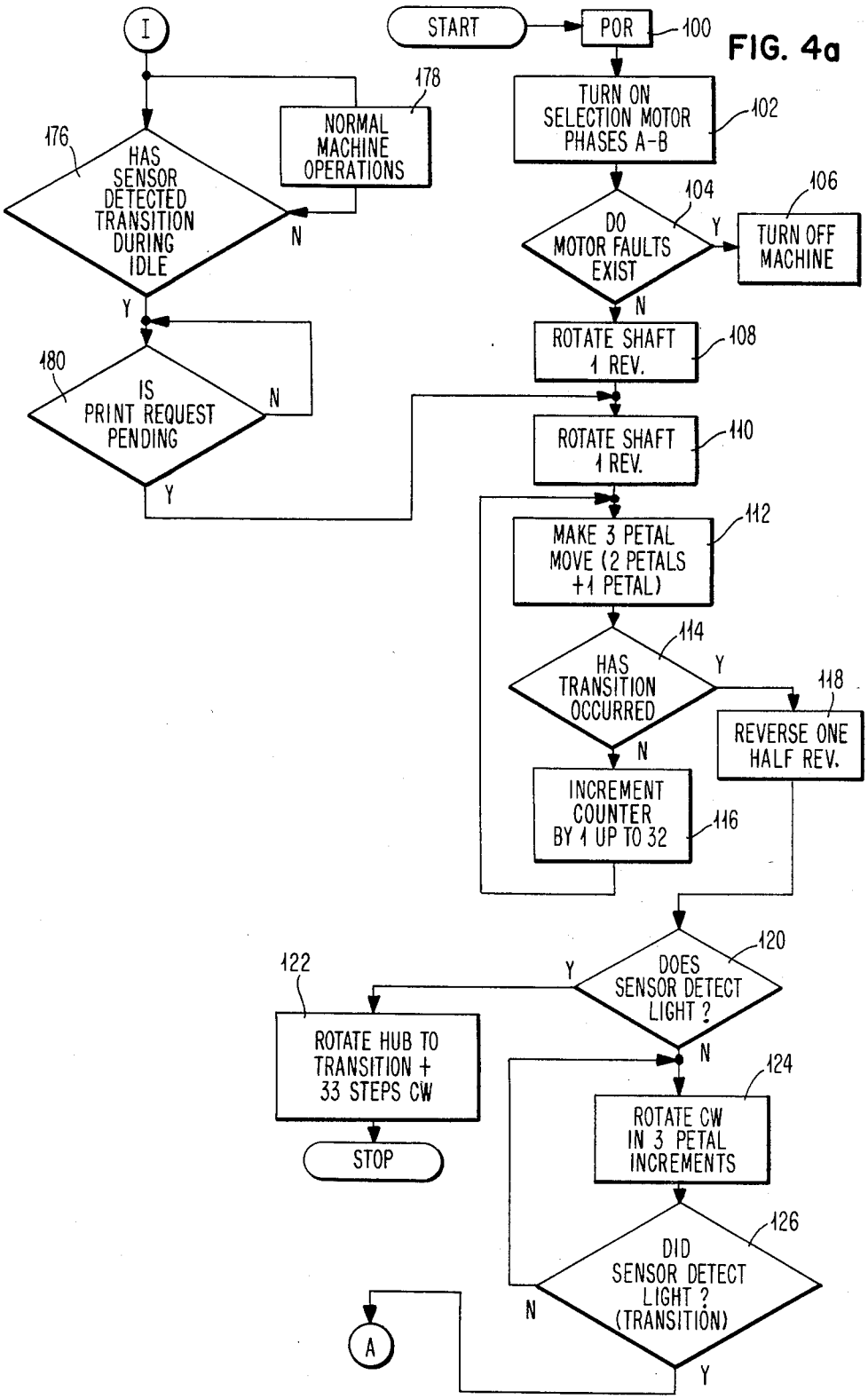
I
START
POR
100
FIG. 4a
TURN ON SELECTION MOTOR PHASES A-B
102
DO MOTOR FAULTS EXIST
104
Y
TURN OFF MACHINE
106
N
ROTATE SHAFT 1 REV.
108
ROTATE SHAFT 1 REV.
110
MAKE 3 PETAL MOVE (2 PETALS +1 PETAL)
112
HAS TRANSITION OCCURRED
114
Y
REVERSE ONE HALF REV.
118
N
INCREMENT COUNTER BY 1 UP TO 32
116
DOES SENSOR DETECT LIGHT ?
120
Y
ROTATE HUB TO TRANSITION + 33 STEPS CW
122
STOP
N
ROTATE CW IN 3 PETAL INCREMENTS
124
DID SENSOR DETECT LIGHT ? (TRANSITION)
126
N
Y
A
HAS SENSOR DETECTED TRANSITION DURING IDLE
176
NORMAL MACHINE OPERATIONS
178
N
Y
IS PRINT REQUEST PENDING
180
N
Y

INITIALIZING APPARATUS FOR DAISY WHEEL PRINTER

DESCRIPTION OF THE INVENTION

FIELD OF INVENTION

The invention relates to impact printers and particularly to daisy wheel printers which require homing of the print wheel and the print wheel line position as well as the detection of escapement pitch and font weight or impact force required for proper printing.

BACKGROUND OF THE INVENTION

The carrier of a daisy wheel printer and hence the print element commonly referred to as the daisy wheel must be homed or positioned properly upon the initiation of power to the printer in order that the carrier and print position defined by the daisy wheel is in a known spacial position with respect to the remainder of the printer. This must be accomplished so that the electronic controls, which control the lateral movement of the carrier and print wheel along the platen, may maintain an accurate indication of the position of the print point and carrier position throughout the printing operations. The print wheel must be rotationally phased or homed to provide a coincidence between a known petal or character and the electronic controls to likewise insure that the elecronics can keep track of the appropriate rotational movement of the printer and thereby be able to accurately and reliably select characters for printing in accordance with the electrical signals processed by the control.

Typewriters which have removable and replacable print elements are capable of printing in more than one pitch and therefore the pitch must be selected. With the pitch properly selected, the escapement distance for each character or spacing command is appropriately sized for the size of the print on the end of the petals of the print wheel.

Printers which have the capability of printing selected ones of a plurality of different print styles, such as replaceable element printers, also are beneficially enhanced by having the ability to select and print using a selected force level.

Prior homing routines involved the driving of the carrier along the print line until the frame or other permanent obstruction interferred with the further movement and the detecting, over a period of time, that the carrier had failed to move or translate in response to the drive signals. The assumption at that time was made that the carrier occupied the leftmost position of the writing line and therefore was at the left frame.

An alternative technique which has been used is to use a microswitch such that the carrier supporting the print wheel will contact the microswitch and indicate to the microprocessor that the carrier has reached a known position while at the same time acting to terminate the further drive of the carrier against the microswitch. At this point, the microprocessor may then reset the appropriate registers to maintain a coincident indication of the location of the carrier as it is then moved outward from the left frame or homing position.

Homing of the print wheel may be accomplished by the use of a photodetection setup such as is disclosed in U.S. Pat. No. 3,574,326 wherein a hole in the print wheel provides an indication of a known position of the print wheel.

Electronic pitch sensing of the pitch of a particular print wheel has been detected by means of a feeler switch sensing the presence of holes in the cartridge of the print wheel/cartridge assembly as described in IBM *Technical Disclosure Bulletin,* Vol. 24, No. 1A, June 1981, pages 146, 147.

It is an object of the invention to photoelectrically detect and communicate the home position of the print wheel in both a lateral and rotary position together with the detection of the pitch for proper escapement and the font weight to insure the desired impact force being applied to each of the print wheels when printing occurs.

SUMMARY OF THE INVENTION

Open loop control of print elements both for rotational movement involving selection and the lateral movement involving escapement requires that the print wheel occupy known spacial positions prior to the initiating of normal printer operations. The LED photodetector disclosed cooperates with the print wheel of a daisy wheel printer, in that the print wheel is coded with apertures in known spacial positions, i.e. home, and a flag member which may be inserted into the light path through the aperture, once the print wheel has been homed. This indicates that the carrier and the print wheel have been translated to a known spacial position along the writing line, i.e. left frame, together with additional apertures formed in the print wheel which allow the sensing of the escapement pitch and the font weight or impact force required for the desired print intensity.

The print wheel is rotated under a power-on reset or POR routine to insure that the apertures of the print wheel pass the light sensor under controlled conditions so that the home position, the escapement pitch information, and the font weight coding are sequentially detected. The carrier supports and carries with it through its movements a small flag member which may be displaced by engaging the end of the shaft of the flag member with the left frame member, thereby forcing the flag to intercept the light beam indicating to the sensor and the microprocessor that the carrier has moved to the left frame.

The microprocessor accepts and processes the indications sent by the photosensor which indicate to the microprocessor that home positions and other printing parameters have been detected. The microprocessor is then capable of resetting its appropriate internal controls to insure that the microprocessor will then function in accordance with the print wheel installed on the typewriter or printer.

DRAWING

FIG. 1 is an exploded view of the print wheel and cartridge with the LED/photodetector in relative position.

FIG. 2 is an exploded view of the photodetector cell, bracket and carrier homing flag.

DETAILED DESCRIPTION OF THE INVENTION

Figure 5:
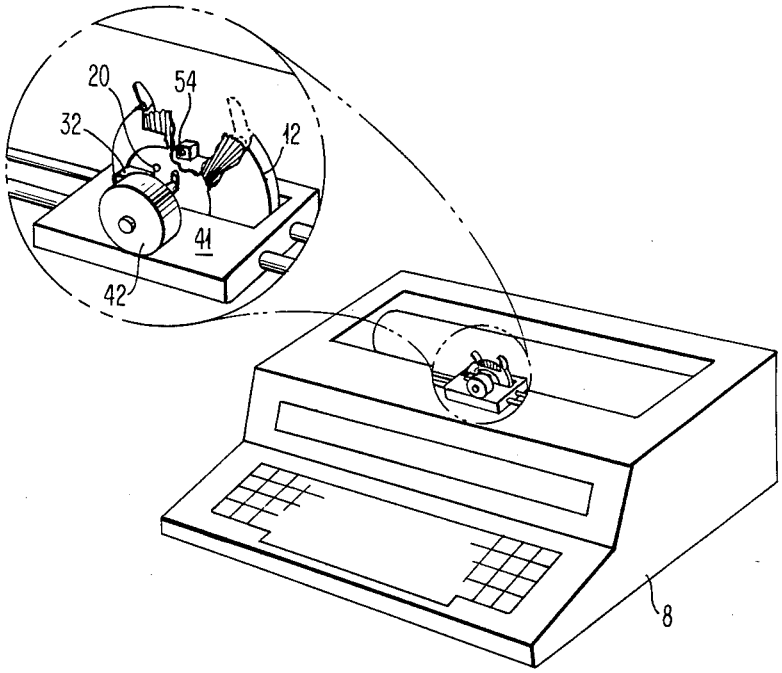
FIG. 5 is a view of the print carrier in the typewriter.

With reference to FIG. 1, the print wheel 10 of the daisy wheel typewriter is contained within a cartridge 12 which serves to position the print wheel 10 within the typewriter 8 (FIG. 5) and to contain the fingers or petals 14 of the print wheel 10 and protect them against damage.

Print wheel 10 is fabricated with a hole 20 formed in the hub 22 of the print wheel 10. Additional holes 24, 26, 28 and 30 may optionally be formed into the hub 22 to denote coded values representing escapement pitch and font weight. The designation of holes 24, 26, 28 and 30 will be more fully discussed later. Mounted on the carrier frame 41 of the typewriter 8 is bracket 32. Bracket 32 acts to support a photodetector cell 34 and a flag member 36 which is spring biased by spring 38 to a withdrawn position away from photodetector 34. Also acting against flag member 36 is plunger 40 which will extend through the side of the carrier frame 41. As the carrier frame 41 moves the print wheel 10 to a position at the left frame of the typewriter 8, plunger 40 will be engaged with the frame and be forced against flag member 36 causing the flag member 36 to move mask photodetector cell 34, indicating the carrier frame 41 is positioned at the left frame of the typewriter 8.

Mounted on the carrier frame 41 is selection motor 42 having a shaft 44 and a key 46. Key 46 is insertable into the locating hole 48 on hub 22 while shaft 44 is inserted into the central axis hole 50.

The light source for the photodetector 34 is mounted on the carrier and retained by housing 52. The light source is an LED or light emitting diode 54 connected to an appropriate electrical power source through connectors 56.

Signals may be transmitted to the microprocessor 60 through connectors 61 which in turn interconnect with connector pins 64 on the photodetector 34.

Figure 3:
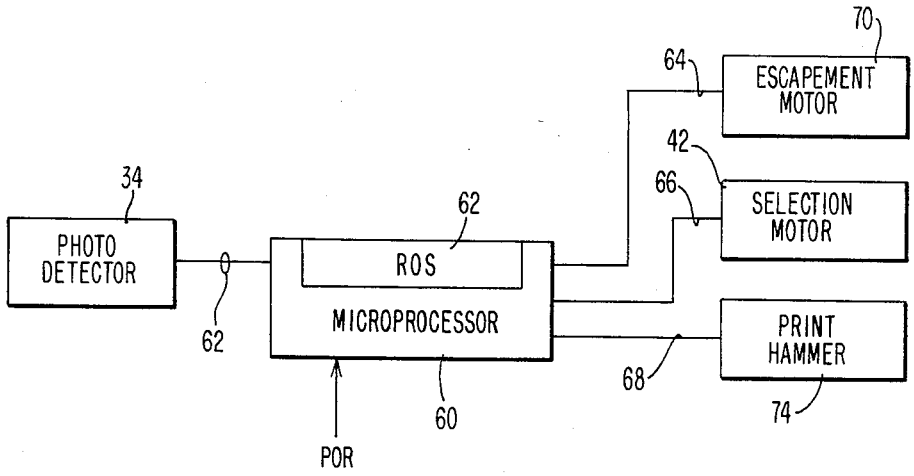
FIG. 3 illustrates a block diagram of the photodetector, the microprocessor and the respective drive outputs from the microprocessor.

With respect to FIG. 3, microprocessor 60 referred to above is any conventional microprocessor which may be purchased, such as by way of example only, an Intel 8051 which in addition to having the appropriate processor circuits on the electronic element also has on chip read-only-storage 62. The read-only-storage (ROS) 62 is preprogrammed to contain the operating instructions for the microprocessor 60 to cause the microprocessor 60 to perform predefined steps and manipulations on data.

An external signal indicated as POR is provided to the microprocessor to cause the microprocessor 60 to start functioning at an appropriate point in the program instructions stored in the ROS 62.

Further interconnected to the microprocessor 60 is the photodetector 34 corresponding to the photodetector 34 in FIG. 1 and connected by means of conductors 61.

The output of the microprocessor 60 is sent through appropriate conductors 64, 66 and 68 to the escapement motor 70, the selection motor 42 and the print hammer 74, respectively.

Figure 4B:
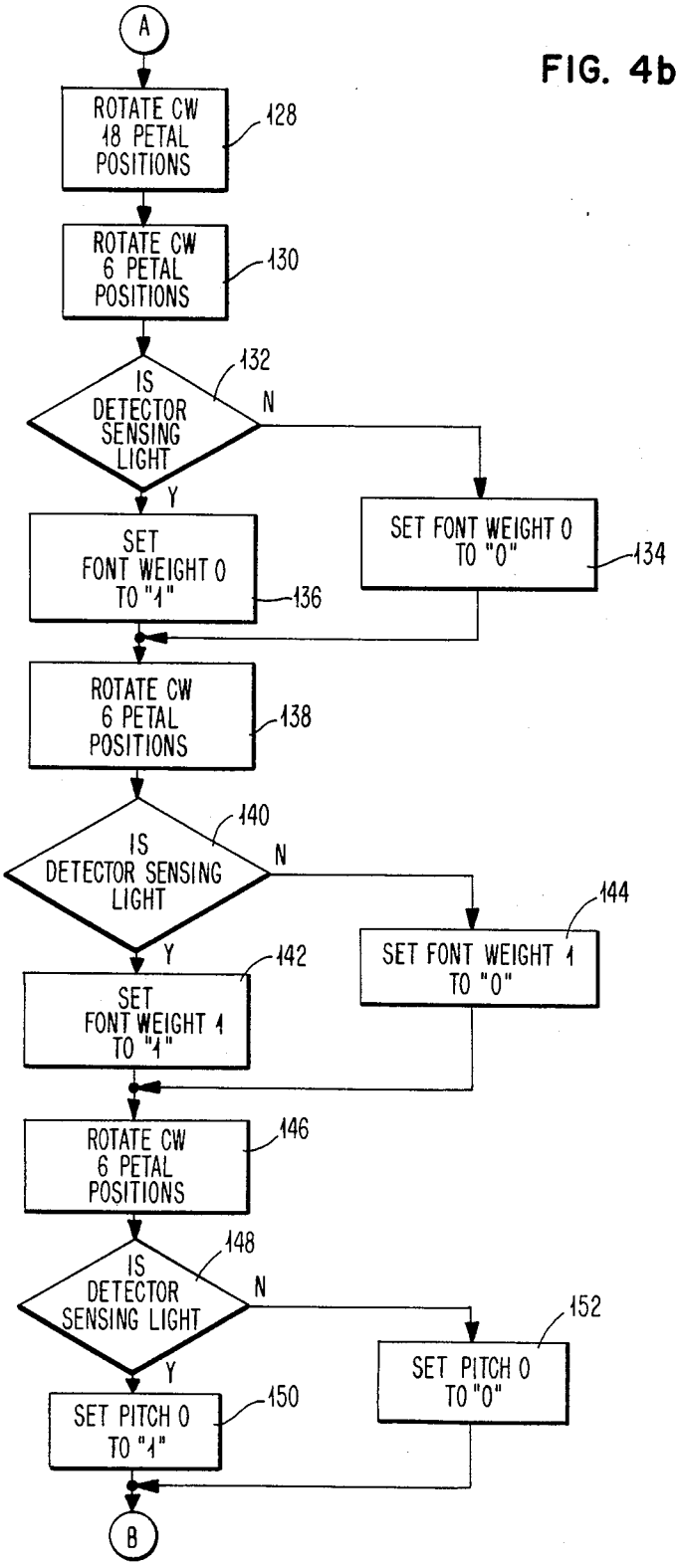
FIG. 4 is made up of three separate drawings, 4A, 4B, 4C, which contain the flow chart indicating the sequential steps of the printer and microprocessor to utilize the photodetector arrangement of FIG. 1 in synchronizing and homing the print wheel and detecting the printing parameters carried thereon.

The program instructions stored in the ROS 62 of the microprocessor 60 are represented in flow chart form in FIGS. 4*a*, *b* and *c*.

PRINTWHEEL HOMING

Starting in FIG. 4*a*, with the POR or power-on reset 100, the selection motor 42 is turned on at block 102 with motor phases A and B activated. Motor 42 is a conventional stepper motor having three phases. One full step of the motor 42 is equal to one petal displacement on the print wheel 10.

The decision block 104 is then entered and a determination of motor faults existing made. In the event that motor faults are detected, the YES path is followed to block 106 where the machine is turned off to prevent damage to either the electronics or the mechanical portions of the typewriter.

If no motor faults are found in block 104, then the flow passes through the NO branch to block 108 wherein a command is issued to rotate the motor shaft 44 one complete revolution. Upon the completion of the move directed in block 108, the motor shaft is now assumed to be engaged with the hub 22 of print wheel 10 and to be rotating the print wheel at any time that the shaft rotates.

After the move directed in block 108, the shaft is rotated one additional revolution as directed in block 110 and then begins a three petal move, implemented by two petal and single petal move commands. The three petal move is directed in block 112. After the three petal move, a decision is made at decision block 114 as to whether a transition of the condition sensed by the photodetector 34 has occurred. If no transition has occurred indicating that no hole in hub 22 has passed photodetector 34, then the path leads to block 116 where a counter in the microprocessor 60 is incremented by one up to a maximum of 32, 32 representing a complete revolution of the wheel, with the flow path reentering the previously described path at a point immediately upstream from block 112 thereby causing another three petal move 112 and another transition decision 114. This loop will then continue until such time as a transition occurs in the light condition detected by photodetector 34. Upon the detection of a transition from dark to light, the motor shaft 44 and print wheel 10 are then reversed one-half revolution in block 118.

This reversal in the rotation through a one-half revolution insures that all apertures in the print wheel will then be positioned such that a clockwise movement of the print wheel will bring the homing aperture 20 into coincidence with the light path between LED 54 and photodetector 34 before any other aperture on the print wheel 10 will pass this point. After the reversal of the print wheel 10 through one-half revolution, a decision is made as to whether the photosensor 34 detects light at block 120. In the event that the photosensor does detect light, the shaft 44 of selection motor 42 is then rotated until such time as the key 46 passes through the light beam from LED 54 to photodetector 34, thus causing a transition and then the stepper motor 42 rotates the shaft 44 by 33 stepper motor steps clockwise. This automatically positions the shaft 44 of the stepper motor 42 in what would be the home position if a print element were attached. After the completion of the above moves as dictated by block 122, the printer is then commanded to stop since no print element is in the printer and is incapable of functioning properly.

Referring back to decision block 120, in the event that the photosensor 34 does not detect light, the NO path is followed to block 124 wherein the stepper motor 42 is commanded to rotate the shaft 44 and print element 10 clockwise in three petal increments with an inquiry at the completion of each three petal increment as to whether the photodetector 34 detected light. Three petal moves are used since the A & B phases of the stepping motor are simultaneously energized every three petal positions and homing is designed to occur when the A & B phases of the stepping motor are energized to insure uniformity of homing. Decision block 126 implementing this query results in two possible paths, with the NO path reentering the flow immediately prior to function block 124, and if the detector senses light as a result of the three petal increment move in function block 124 as indicated by decision block 126, the print wheel 10 is now homed and the YES path is followed to block 128 which dictates that the shaft 44 be rotated clockwise 18 petal positions to start the next sequence.

The rotation dictated by block 128 is followed by a six petal clockwise rotation as indicated in block 130. The six petal rotation of block 130 positions the print wheel rotationally such that the light beam may pass through the wheel if a data or coding aperture 24 exists at that position to start detecting font weight or the force with which a character is struck to cause printing.

If the result of the test in decision block 132 is NO indicating that there is no aperture in position 24 adjacent the LED 54 and photodetector 34, then the NO path is followed to block 134, wherein the first digit of a binary number representing font weight designated as font weight 0 is set to 0.

If the answer to the test conducted in decision block 132 indicates that an aperture 24 exists at the position occupied by the light beam relative to print wheel 10, then the YES path is followed and font weight 0 is set to 1 in block 136.

The flow from both block 134 and block 136 then joins and passes to block 138 where an additional six petal clockwise rotation is commanded. This rotation effects the positioning of the print wheel 10 and hub 22 such that if an aperture exists at the position corresponding to that indicated as aperture 26 that the test performed in decision block 140 of whether the detector is sensing light will yield either a YES or NO decision. If the answer is a YES decision, the font weight 1 digit is set to a 1 value as indicated in block 142, while if the NO answer is a result of the test in block 140, then the path leads to block 144 wherein the font weight 1 is set to 0.

Figure 4C:
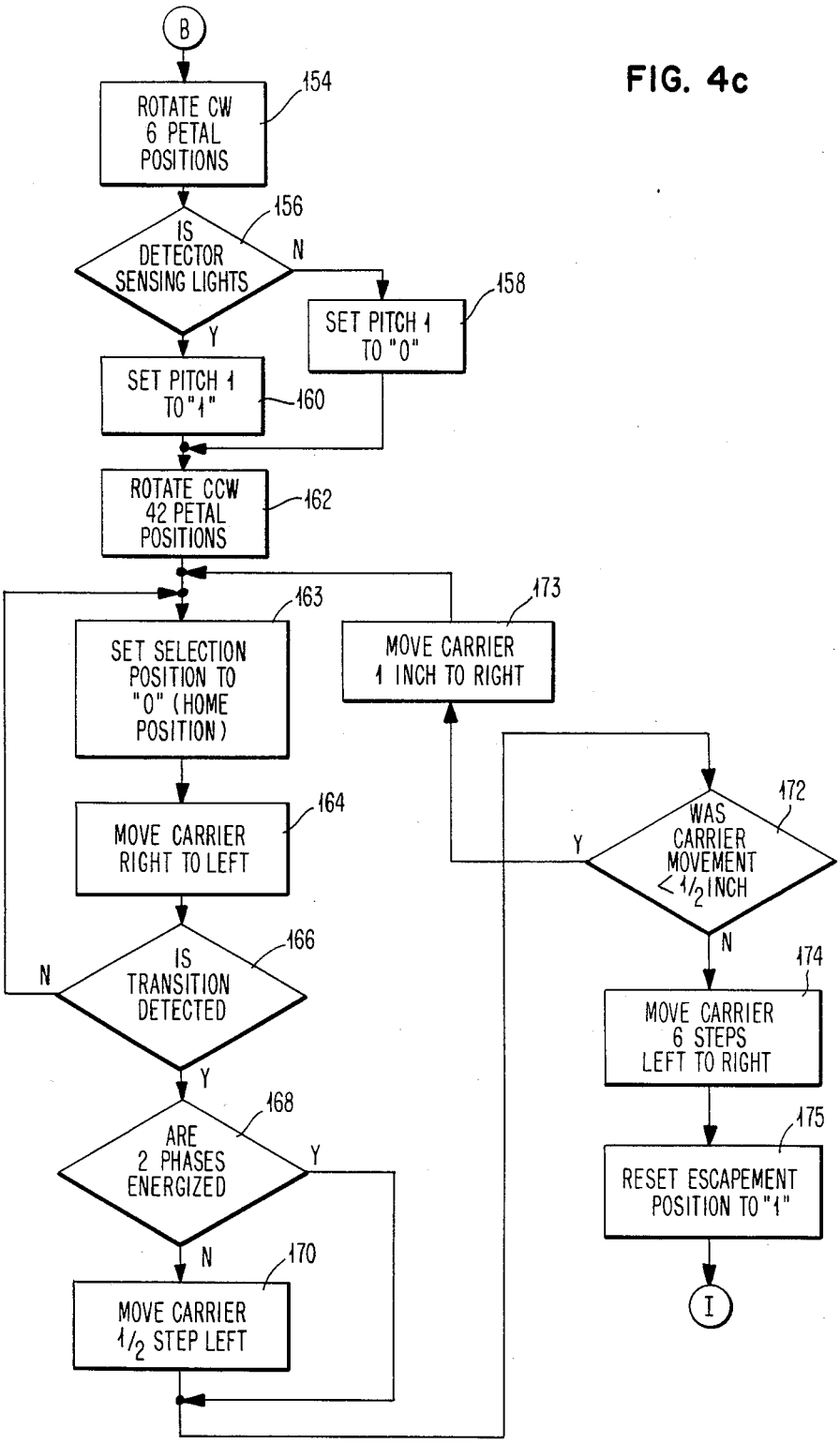

In any event, the flow from block 142 and 144 join and pass to block 146 wherein an additional six petal clockwise rotation is commanded. This positioning now prepares the printer for detecting the pitch code so that the printer may be conditioned to escape the proper distance. The print wheel 10 at this point is positioned to detect the presence or absence of a hole as indicated at 28 in FIG. 1. This is the first of the detected digits for the pitch sensing. The decision in block 148 determines whether the detector 34 is sensing light and if the detector 34 is sensing light, then the pitch 0 value is set to 1 as indicated in block 150. In the event that the detector 34 does not sense light in the decision represented by decision block 148, the NO path directs the flow to block 152 wherein the pitch 0 digit is set to 0 with the flow from block 152 joining with the flow path from block 150 and passing to block 154 of FIG. 4*c*.

In response to the command represented by block 154, the stepper motor 42 will rotate shaft 44 and print wheel 10 six petal positions clockwise to position the print wheel such that an aperture at position 30 in FIG. 1 may be sensed by the photodetector 34. Upon the completion of the move, the decision is made as to whether the detector is sensing light, as represented in decision block 156, with a flow path representing the NO answer directed to block 158 wherein the pitch 1 digit is set to 0. If the detector is sensing light, the YES path directs flow to the block 160 wherein the pitch 1 digit is set to 1 with the flow from block 158 and block 160 joining and directed to block 162 wherein a command is generated to rotate in a counterclockwise direction 42 petal positions. The counterclockwise rotation of 42 petal positions places the print wheel 10 in its home position after having appropriately sensed the font weight and pitch coding.

At this point, the selection position count or value is set to 0 indicating that the print wheel is at the home position as indicated in block 163. The 42 petal counter clockwise move of the print wheel in block 162 returns the print wheel to its home position after homing, font weight sensing and pitch sensing. The selection position count is incremented up or down to represent the petal presented at the print point as the stepper motor 42 is pulsed to rotate the print wheel 10.

Upon the completion of the movement of the print element to its home position as indicated in block 162, the carrier is then driven by the escapement motor 70 from right to left. The command to move the carrier from right to left is issued as a result of function block 164.

The microprocessor 60 may operate at a much faster rate than the escapement motor 70 and, as a result, the sampling of the photodetector 34 to detect whether a transition has occurred during the right to left movement of the carrier may be accomplished at an exceedingly high rate of speed. Therefore, the decision block 166 represents a test to detect a transition from light to dark of the photodetector 34. If no such transition has occurred, then the command to move the carrier is renewed by following the NO path back to a point immediately prior to block 164 and reentering the command to move the carrier from right to left.

Upon the detection of a transition by the test represented by decision block 166, the flow passes through the YES path to decision block 168 to determine whether two phases of the motor 42 are energized. In the event that two phases of the motor 42 are not energized, then an additional command to move the carrier one-half step left is effected as represented by block 170. In the event that two phases of the motor 42 are energized at the time the decision block 168 is effective, the flow will branch and pass block 170 and thereby not effect any further leftward movement of the carrier. This test insures that the carrier is repeatedly positioned precisely notwithstanding the relatively coarse detection apparatus.

In any event, the path from block 170 and the affirmative path from block 168 join and pass into decision block 172 wherein a determination is made whether the carrier movement was less than one-half inch. In the event that the carrier movement was in fact less than one-half inch, then the test in decision block 172 is satisfied and the YES path flows from that block 172 back to block 173 to effect a one inch right move and then the flow continues to a point in the flow diagram immediately prior to function block 163.

If the test in decision block 172 is not satisfied, then the carrier is moved 6 steps left to right, block 174, to move the carrier away from the left frame to position the carrier at the active left limit. To initialize the escapement position count, the count is set to 1 to represent the first print position on the print line, block 175. The flow then is directed back to FIG. 4*a* and enters the decision block 176 wherein a test is made as to whether the sensor has detected a transition during the idling of the typewriter. This decision test is for the purpose of detecting a change of print wheels 10 which will cause a transition when the print wheel is removed from the typewriter and another transition will then be detected upon the reinsertion of an additional cartridge such as cartridge 12. In the event that no transition has been detected, the flow path then branches through the NO path to function block 178 representing normal machine operations. Anytime the normal machine operations are not occurring, the loop will continue to sample to detect whether there has been a transition.

When a transition is detected representing a change in print wheels or the removal of a print wheel, the routine will not function until a print request is pending. This aspect is illustrated at decision block 180 where a NO response to the test causes a delay looping. When a print request is detected, the YES path reenters the main homing flow between blocks 108 and 110 to cause the new print wheel to be homed prior to printing of the requested character.

The location of the font weight, escapement pitch and home indicia are all positioned within a semicircle of the typefont to insure that accurate sensing will occur.

I claim:

1. A printer comprising an electronic control and an escapement means for escaping on one of plural escapement pitches, a carrier, a print element carried on said carrier and carrying indicia of the escapement pitch and impact level associated with said print element, and impact means for impacting with one of a plurality of impact levels, comprising an initialization means, said initialization means comprising:

a single detection means, comprising a single sensor and a plurality of light transition creating means, for detecting the presence of said print element in a predefined rotary position, the presence of said print element in a predefined lateral position, the indicia indication of escapement pitch and impact level associated with said print element, and means for synchronizing said electronic control with said print element lateral position and said print element rotary position and means for conditioning said typewriter to escape in said pitch and to print with said impact level.

2. The printer of claim 1 wherein said electronic control is a microprocessor.

3. The printer of claim 1 wherein said indicia comprises passages for a light beam through said print element.

4. The printer of claim 1 where said means for detecting comprises a light source positioned on said carrier on one side of said print element and an optical sensor positioned on the opposite side of said print element and a light interrupter carried by said carrier.

5. The printer of claim 4 wherein said light interrupter is carried by said carrier and is responsive to engagement with a fixed member of said typewriter to interrupt said light source.

6. The printer of claim 5 wherein said light interrupter is a moveable light shutter.

7. The printer of claim 6 wherein said fixed member comprises a frame of said printer.

8. The printer of claim 2, said escapement means comprises a stepping motor having a plurality of phases and wherein said microprocessor controls said stepping motor to position said carrier in said predefined position with more than one phase of said stepping motor energized.

9. The printer of claim 3 wherein said indicia are all positioned in a semicircular region of said print element.

10. A typewriter having a replaceable daisy wheel print element, a moveable carrier for said print element, and a hammer for impacting said print element, comprising:

an initializing means for insuring said carrier and said print element are positioned in known spacial positions to be synchronized with controls for said carrier and said print wheel, said initializing means comprising:

an electronic control for providing operational signals to said typewriter, an escapement means responsive to said electronic control for moving said carrier, a selection means responsive to said electronic control for rotating said print element; indicia carried by said print element as an indication of rotational orientation, escapement and impact level of said hammer, a single detection means comprising an optical sensor and a light source for providing light to said optical sensor, associated with said carrier and said indicia, a light interrupter associated with said carrier and said light source, read only store memory for controlling said electronic control to perform an initialling sequence, said electronic control responsive to said read only store memory for providing drive signals to said escapement means to move said carrier to a known spacial position, said light interrupter, responsive to said moving of said carrier, interrupts said light upon said carrier occupying said known spacial position, said electronic control connected to said selection means to effect rotation of said print wheel and said indicia past said detection means for reading of said indicia, said detection means connected to said electronic control to provide sensor signals representative of said indicia to said electronic control, said electronic control responsive to said sensor signals to determine when said carrier and said print element are positioned in said known spacial positions, and to determine the escapement value for said print element and to determine the impact level required for said print element.

* * * * *